US006263804B1

(12) United States Patent
Rizk

(10) Patent No.: US 6,263,804 B1
(45) Date of Patent: Jul. 24, 2001

(54) DUAL LEVEL ACCESS DOOR SYSTEM FOR RAILWAY VEHICLES

(75) Inventor: Magdy A. Rizk, Brossard (CA)

(73) Assignee: Tekdata Inc., Brossard (CA)

( * ) Notice: Subject to any disclaimer, the term of this patent is extended or adjusted under 35 U.S.C. 154(b) by 0 days.

(21) Appl. No.: 09/358,460

(22) Filed: Jul. 22, 1999

(51) Int. Cl.[7] ..... B60R 3/00

(52) U.S. Cl. ..... 105/343; 105/430; 105/329.1; 105/427; 105/438; 105/437; 105/450; 296/155; 280/166

(58) Field of Search ..... 105/329.1, 331, 105/332, 333, 339, 427, 430, 438, 437, 431, 443, 450, 343; 104/27, 28, 30; 280/166; 296/155

(56) References Cited

U.S. PATENT DOCUMENTS

| | | | | |
|---|---|---|---|---|
| 961,024 | * | 6/1910 | Saunders | 105/333 |
| 2,546,626 | * | 3/1951 | Beezhold | 105/430 |
| 3,724,396 | * | 4/1973 | Roth | 105/378 |
| 3,795,205 | * | 3/1974 | Gritchen et al. | 105/450 |
| 3,924,545 | * | 12/1975 | Anders et al. | 105/450 |
| 4,175,495 | * | 11/1979 | Kleim | 105/450 |
| 4,482,113 | * | 11/1984 | Backlund et al. | 244/129.5 |
| 5,070,794 | * | 12/1991 | Kunst et al. | 105/436 |
| 5,845,579 | * | 12/1998 | Langley et al. | 104/31 |

FOREIGN PATENT DOCUMENTS

| | | | | |
|---|---|---|---|---|
| 2234281A | * | 1/1991 | (GB) | E06B/11/02 |

* cited by examiner

*Primary Examiner*—S. Joseph Morano
*Assistant Examiner*—Frantz F. Jules
(74) *Attorney, Agent, or Firm*—Swabey Ogilvy Renault; Robert Mitchell

(57) ABSTRACT

A door system for a railway car which provides for both high and low level access. The door system comprises a sliding door, a platform displaceable between raised and lowered positions for respectively clearing and covering the stairwell of the railway car, and a threshold extending laterally outwardly of the sliding door to provide a continuation of the platform when displaced to its lowered position. The threshold is releasably connected to the sliding door for co-linear movement with the sliding door when the platform is raised, while remaining stationary in a functional position when the platform is lowered for enabling high level boarding.

15 Claims, 5 Drawing Sheets

DUAL LEVEL ACCESS DOOR SYSTEM FOR RAILWAY VEHICLES

BACKGROUND OF THE INVENTION

1. Field of the Invention

The present invention relates to door systems for railway vehicles and, more particularly, to door systems which provide for boarding from both high and low level platforms.

2. Description of the Prior Art

Railway vehicles are often used on railroad lines having passenger stations equipped with high boarding platforms extending at the vehicle floor level and others with low level boarding platforms extending at or near ground level.

Accordingly, efforts have been made to develop door systems providing for both high and low level access. For instance, U.S. Pat. No. 5,070,794 issued on Dec. 10, 1991 to Kunst et al. discloses a multi-sectioned sliding door assembly for use with a railway vehicle having a stairwell extending downwardly from the floor of the vehicle to a lower boarding level. The sliding door assembly comprises an upper sliding door displaceable to an open position for high level boarding and a lower sliding door disposed immediately below the upper sliding door and displaceable therewith to an open position for low level boarding. The upper sliding door is supported at the top by a sliding connection to a door overhead structure. An upper threshold is secured to an upper outer section of the lower sliding door to be positioned adjacent an elevated platform of a train station. The lower sliding door is connected via a slide assembly to the railway vehicle structure in the region of the upper threshold platform. In addition, the bottom of the lower door panel is guided in a lower threshold. A stairwell platform is hingedly connected to one side of an upper horizontal plane of the stairwell for covering the same during high level boarding.

Although the door assembly of the above mentioned patent is effective for enabling both high and low level boarding operations, it has been found that there is a need for a simpler system which requires fewer adjustments.

SUMMARY OF THE INVENTION

It is therefore an aim of the present invention to provide an improved door system providing for both high and low level access.

It is also an aim of the present invention to provide a door system which is relatively simple and economical to manufacture.

Therefore, in accordance with the present invention there is provided a door system for a railway vehicle having a door opening and a stairwell extending downwardly from a vehicle floor level to a bottom end of the door opening, the door system comprising a sliding door displaceable between open and closed positions for selectively closing the door opening, a stairwell platform displaceable between a retracted position for clearing the stairwell and an extended position for covering the stairwell, and a threshold extending laterally outwardly of the sliding door substantially at the vehicle floor level, the threshold being releasably connected to the sliding door for conjoint movement therewith when the stairwell platform is in the retracted position thereof, while remaining stationary in a functional position when the stairwell platform is in the extended position thereof for allowing high level boarding.

In accordance with a further general aspect of the present invention, there is provided a door system comprising a sliding door displaceable between open and closed positions, a stairwell platform displaceable between a retracted position for clearing a railway vehicle stairwell and an extended position for covering the stairwell, and a threshold extending laterally outwardly of the sliding door substantially at the vehicle floor level, the threshold being adapted to move with the sliding door and to be made stationary in a functional position thereof by engagement of the threshold with a retainer upon positioning of the stairwell platform to the extended position thereof.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
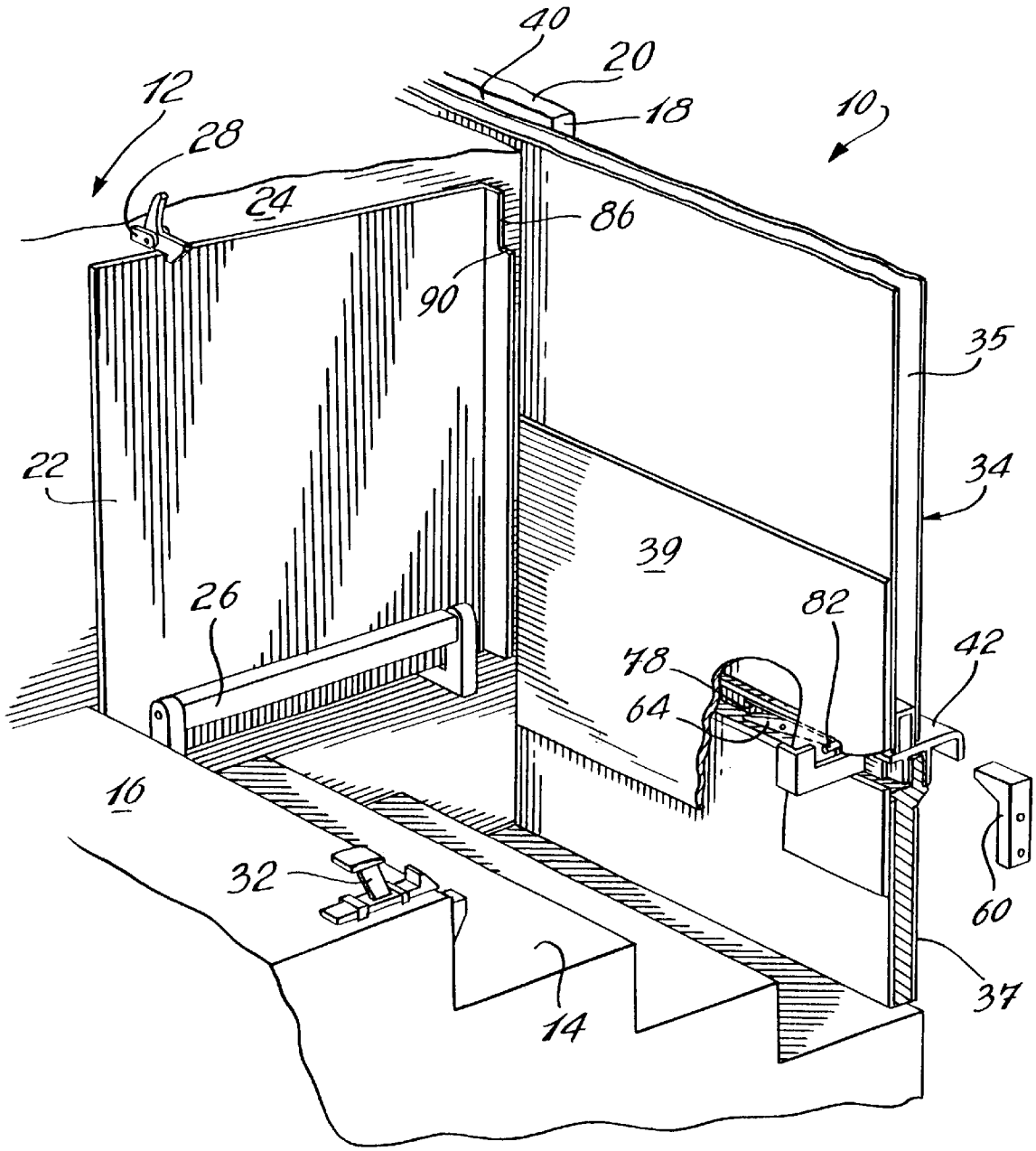
FIG. 1 is a fragmented perspective view of a dual level access door system used in combination with a railway vehicle in accordance with a preferred embodiment of the present invention.

Now referring to the drawings, and in particular to FIGS. 1 to 3, a dual level access door system 10 suited for use in combination with a railway vehicle 12 and embodying the elements of the present invention will be described.

Figure 2:
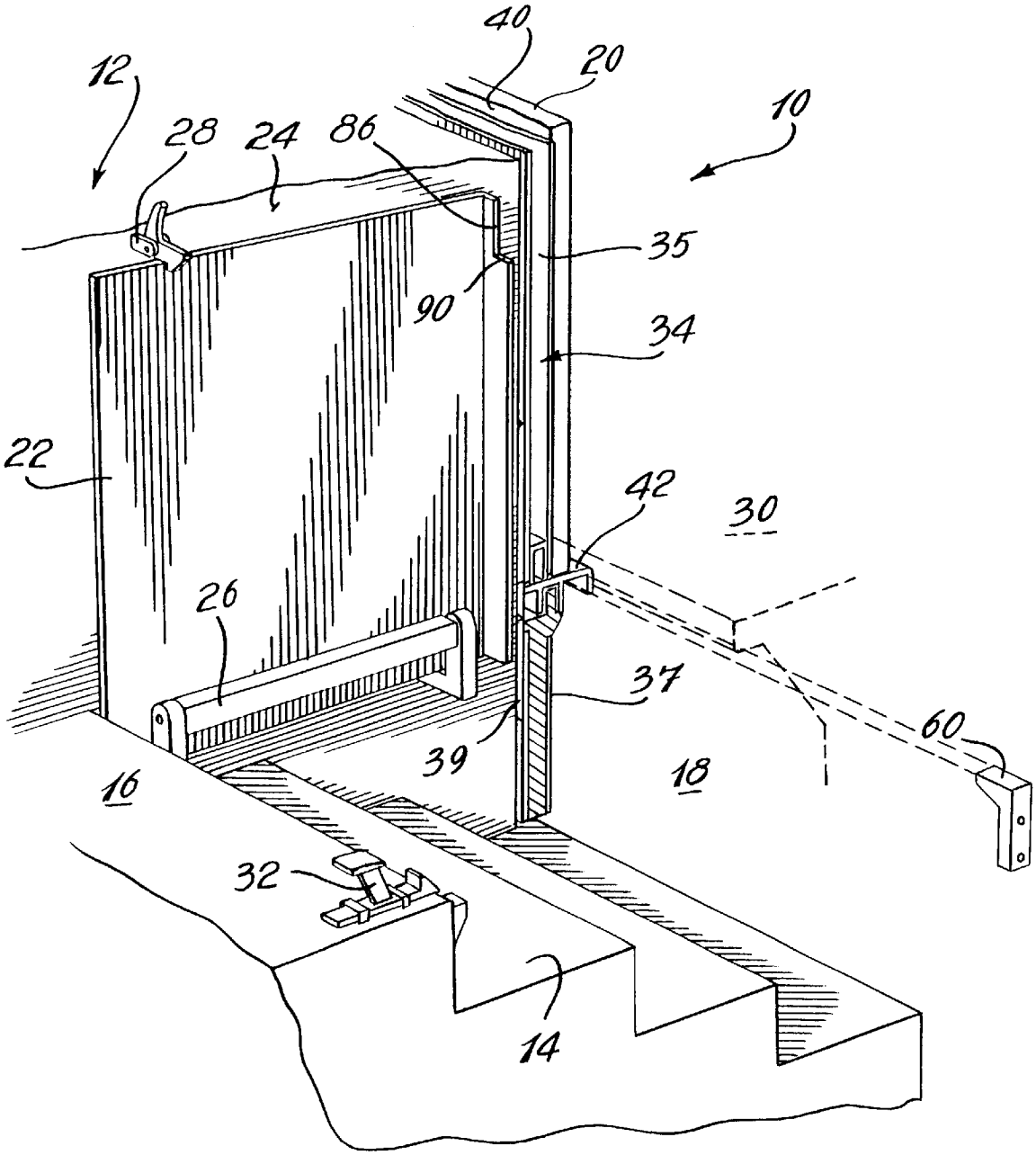
FIG. 2 is a fragmented perspective view of the dual level access door system of FIG. 1, showing a sliding door displaced to an open position thereof together with an upper threshold for allowing low level embarkment and disembarkment of passengers.
Figure 3:
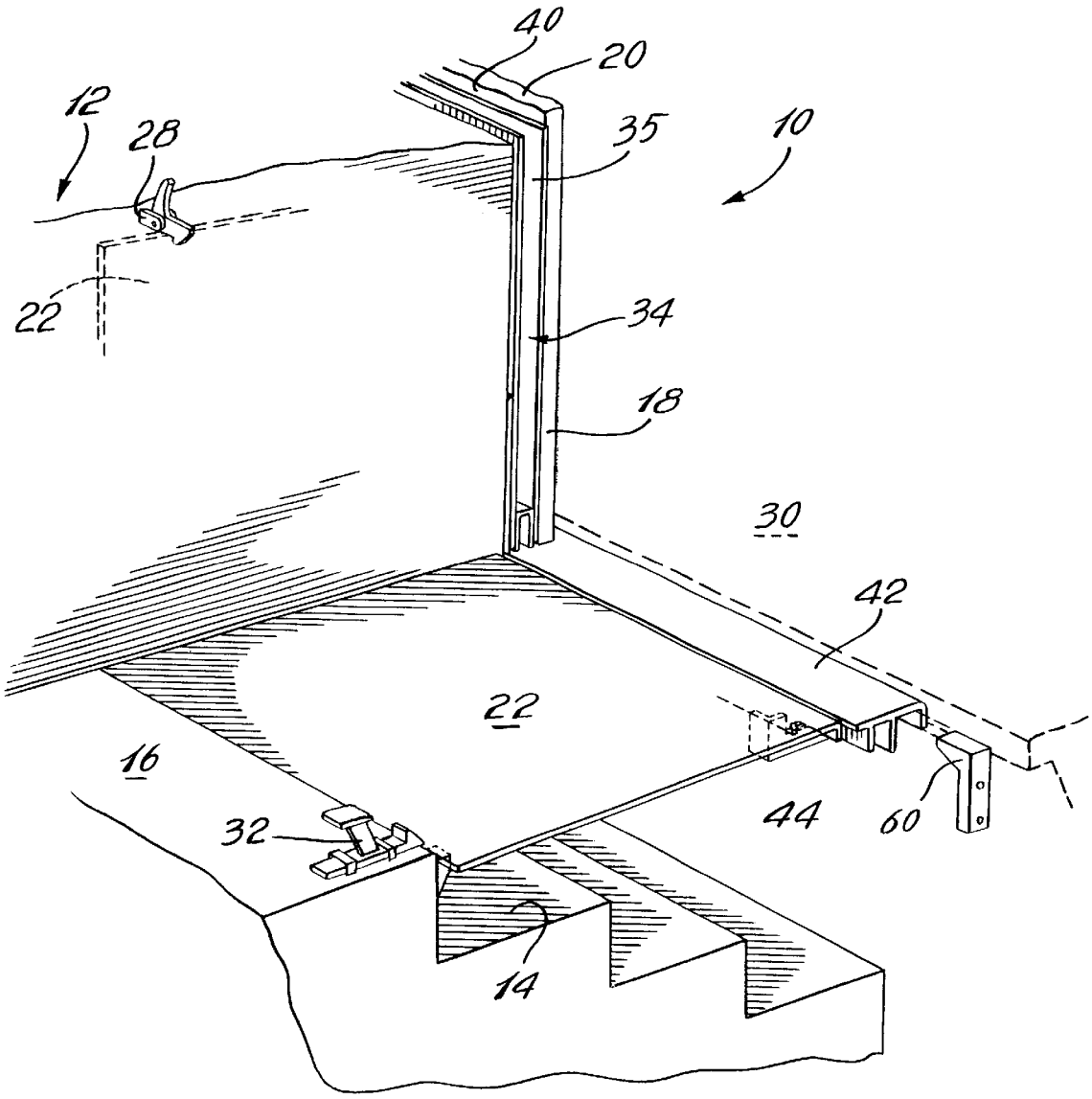
FIG. 3 is a fragmented perspective view of the dual level access door system of FIG. 1, showing the sliding door displaced to the open position thereof independently of the upper threshold which has remained stationary in order to bridge the space between a stairwell platform and an elevated platform of a train station.

As seen in FIGS. 1 to 3, the railway vehicle 12 has a stairwell 14 extending downwardly from a floor 16 and leading to a door opening 18 defined in a side wall 20 of the railway vehicle 12.

A stairwell platform 22 is pivotally mounted at a lower edge thereof to a side wall 24 of the stairwell 14 by means of a hinge 26. A latch 28 is provided for maintaining the stairwell platform 22 in a retracted or raised position thereof adjacent the side wall 24 during low level platform embarkment and disembarkment of passengers. By unlocking the latch 28, the stairwell platform 22 can be manually swung down to an extended position, as shown in FIG. 3, wherein the stairwell platform 22 covers the stairwell 14 and provides a continuation of the floor 16 for allowing ingress and egress of passengers from an elevated boarding platform 30 of a train station. A lock 32 is provided on the floor 16 on the other side of the stairwell 14 for releasably securing the stairwell platform 22 in the extended or lowered position thereof.

The door system 10 further comprises a sliding door 34 formed of an upper section 35 fixedly secured to a lower section 37 by means of a connecting plate 39 bolted or otherwise secured to respective inner surfaces of the upper and lower sections 35 and 37. The upper section 35 of the sliding door 34 is slidably mounted at an upper end thereof to a door overhead structure (not shown) forming part of the railway vehicle 12. A strip (not shown) depends from the bottom side of the lower section 37 of the sliding door 34 for engagement in a corresponding longitudinal guiding groove (not shown) defined in the top surface of a lower threshold (not shown) secured to the railway vehicle 12. The strip is made of a low friction material, such as nylon. An actuating mechanism (not shown) is provided for sliding the door 34 between open and closed positions. The sliding door 34 is slid open into a door receiving cavity 40 provided in the side wall 20 of the railway vehicle 12.

An upper threshold 42 extends laterally outwardly of the sliding door 34 to provide a continuation of the stairwell platform 22 in order to bridge the space between an elevated boarding platform, such as at 30, and the stairwell platform 22. The upper threshold 42 is releasably connected to the sliding door 34 via a lock mechanism 44.

When the stairwell platform 22 is held in the raised position thereof, the upper threshold 42 is secured to the sliding door 34, via the lock mechanism 44, for movement as a unit with the sliding door 34, as seen in FIG. 2. This enables passengers to ingress and egress at ground level via the stairwell 14.

However, when the stairwell platform 22 is in its lowered position, as shown in FIG. 3, the upper threshold 42 is disconnected from the sliding door 34 and held in place by the stairwell platform 22. The sliding door 34 can then be displaced into the door receiving cavity 40, while the upper threshold 42 remains in a functional position thereof to bridge the space between the stairwell platform 22 and an elevated boarding platform, such as at 30.

Figure 4:
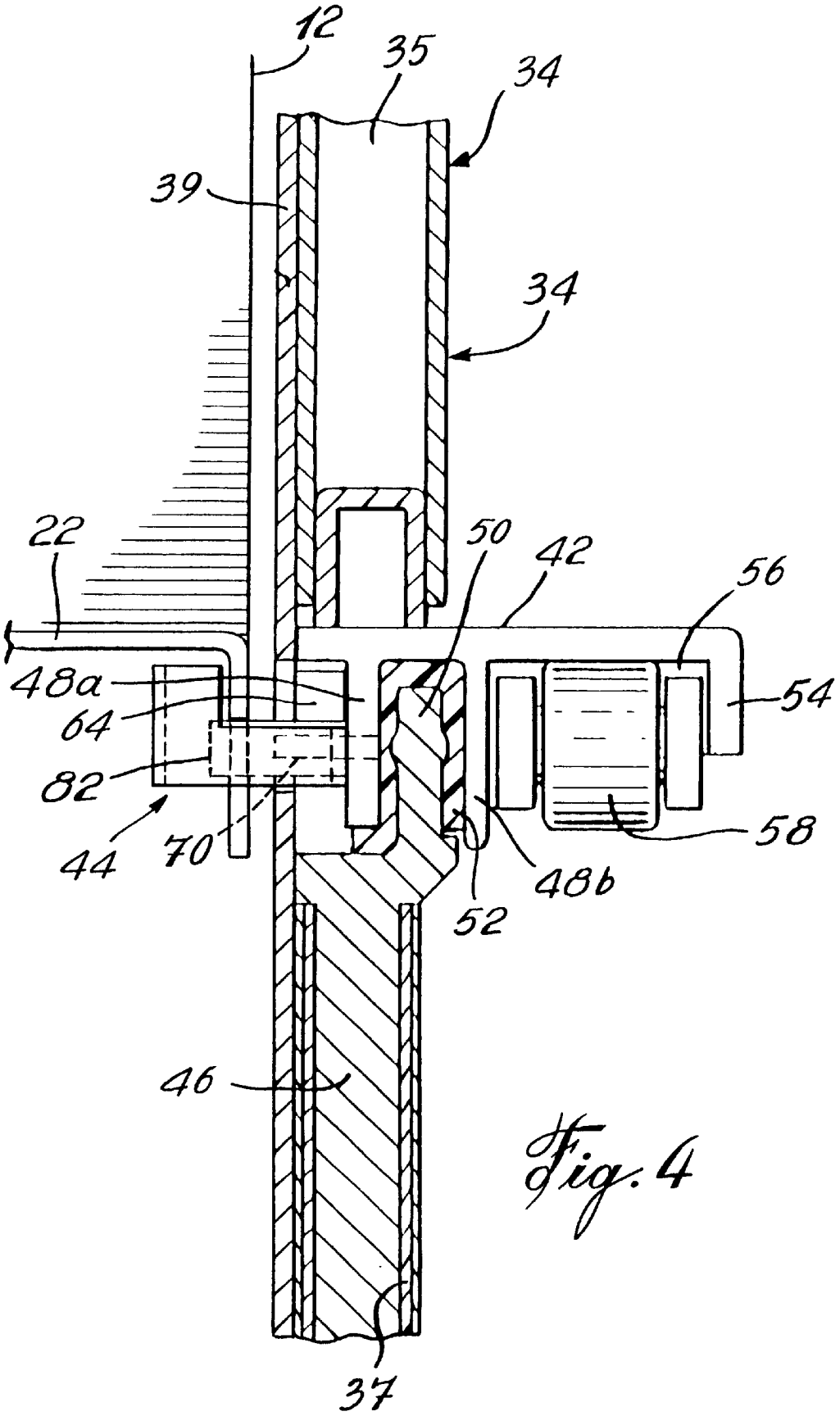
FIG. 4 is a longitudinal cross-sectional view of the sliding door, illustrating the construction of a lock mechanism used to selectively connect and disconnect the upper threshold to the sliding door.
Figure 5:
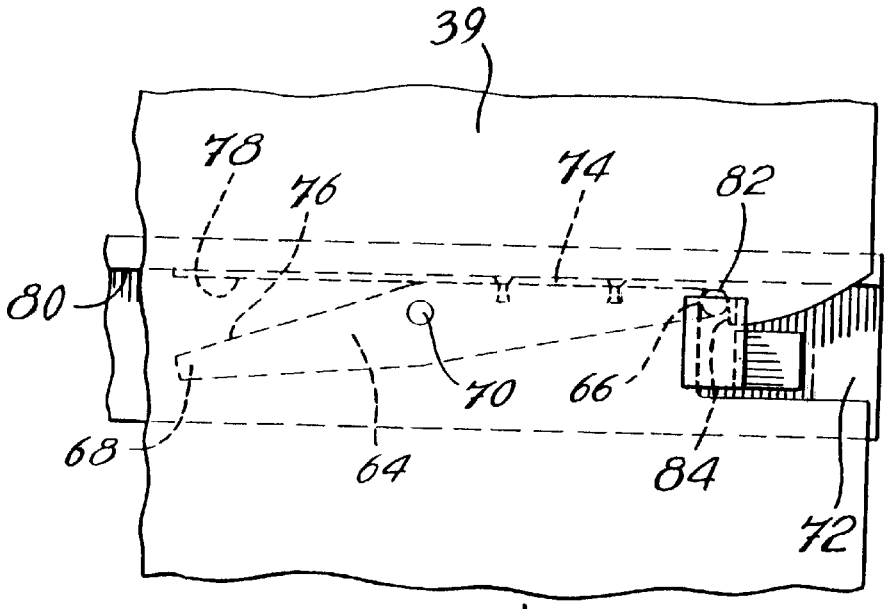
FIG. 5 is an enlarged side view of the lock mechanism shown in an engaged position wherein the upper threshold is secured to the sliding door.
Figure 6:
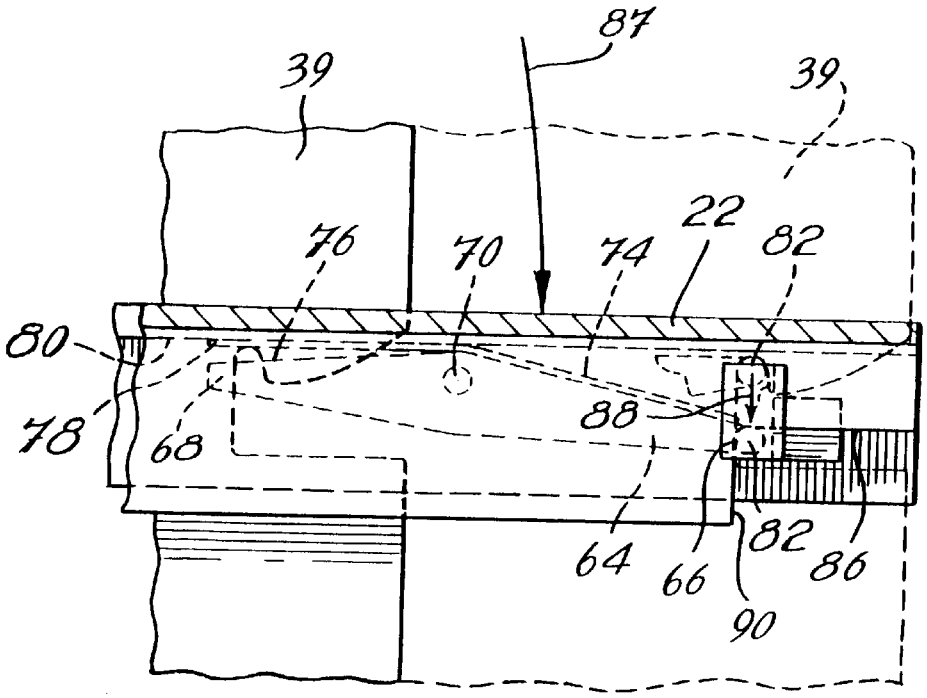
FIG. 6 is an enlarged side view of the lock mechanism illustrating how the lock mechanism is displaced to a disengaged position wherein the upper threshold is disconnected from the sliding door.

Referring now more specifically to FIGS. 4 to 6, there will be described the construction and operation of the upper threshold 42 and of the associated lock mechanism 44.

As seen in FIG. 4, the upper threshold 42 is slidably mounted on a support member 46 inserted in position within the lower portion 37 of the sliding door 34 for movement therewith. The upper threshold 42 is provided with a pair of spaced-apart parallel rail engaging members 48*a* and 48*b* adapted to receive therebetween an horizontal rail 50 formed at an upper end of the support member 46. The rail 50 extends along an outer side of the sliding door 34 in a direction of motion thereof. An insert 52 made of a low friction material and having an inverted U-shaped portion is fixedly mounted on the rail 50 to provide an adequate sliding surface for the upper threshold 42. According to a construction of the present invention, the upper threshold 42 and the support member 46 are made of aluminum, whereas the insert 52 is made of plastic.

The outer longitudinal side 54 of the upper threshold 42 extends downwardly to form a guide 56 with the rail engaging member 48*b*. A roller assembly 58 is mounted in the door receiving cavity 40 for engagement within the guide 56 so as to provide a support surface for the upper threshold 42 and at the same time prevent the sliding door 34 from swinging. As seen in FIGS. 1 to 3, a support 60 is mounted to the structure of the railway vehicle 12 on the side of the door opening 18 opposed to the door receiving cavity 40 to support the upper threshold 42 when the same is displaced to the functional position thereof. Accordingly, the upper threshold 42 is supported at opposed ends thereof when displaced to its functional position.

As seen in FIGS. 4 to 6, the lock mechanism 44 comprises a pivotal latch 64 having first and second end portions 66 and 68. A pivot pin 70 is provided intermediate the first and second end portions 66 and 68 of the latch 64 to pivotally connect the same to an outer surface 72 of the rail engaging member 48*a* for rotation in a plane parallel to the sliding door 34. The latch 64 has an inverted V-shaped top surface formed of a first segment 74 and second segment 76. A spring blade 78 is secured at one end thereof to the first segment 74 and engaged at opposed end thereof with an undersurface 80 of the upper threshold 42 for normally urging an engaging portion or pin 82 extending at right angles from the first end 66 of the latch 64 in the upper end of a vertical slot 84 defined at one end of the connecting plate 39. In this position, the first segment 74 is substantially parallel to the undersurface 80 of the upper threshold 42 and the latter is connected to sliding door 34 for movement therewith. Accordingly, when the door actuator (not shown) is powered to displace the sliding door 34 to its open position, as seen in FIG. 2, the force applied to the sliding door 34 by the door actuator will be transmitted to the upper threshold 42 via the connecting plate 39. No relative motion will occur between the upper threshold 42 and the rail 50 and, thus, the sliding door 34 and the upper threshold 42 will move as a unit to allow ground level boarding.

It is understood that other catch mechanisms could be used as an alternative to the above described vertical slot 84.

As seen in FIGS. 1, 2 and 6, the stairwell platform 22 is provided with a pin engaging surface 86. When the stairwell platform 22 is lowered to its extended position as depicted by arrow 87 in FIG. 6, the pin 82 is engaged by the engaging surface 86, thereby causing the latch 64 to pivot about the pivot pin 70 in a clockwise direction against the spring force exerted by the spring blade 78 so as to displace the pin 82 in a downward direction, as depicted by arrow 88. This causes by pin 82 to move out of the vertical slot 84, thereby disconnecting the latch 64 and, thus, the upper threshold 42 from the connecting plate 39. The stairwell platform 22 is further provided with a pin abutment surface 90 extending at right angles to the pin engaging surface 86 to prevent the upper threshold 42 from being retracted with the sliding door 34. Therefore, the stairwell platform 22 acts as a retainer having an abutment surface adapted to maintain the upper threshold 42 stationary while the door 34 is being opened. Accordingly, when the sliding door 34 is displaced to its open position, the upper threshold 42 will remain stationary and the rail 50 will slide between the rail engaging members 48*a* and 48*b*.

A guard (not shown) may be provided to preclude unauthorized access to the pin 82. Another guard (not shown) could be mounted to the outer surface of the sliding door 34 to protect the upper threshold 42 from the elements while the sliding door 34 is closed.

The above described door system 10 advantageously simplifies the sliding assembly of the door and reduces the number of adjustments which are required to maintain the functionality of the door system. Furthermore, by slidingly connecting the sliding door 34 to an overhead structure of the railway vehicle 12 and connecting the bottom of the sliding door 34 to a lower threshold 38 via a strip, such as a weather-strip, binding of the sliding door 34 will be prevented upon racking and twisting of the railway vehicle 12. Finally, the fact that the sliding door 34 always moves as a single unit, allows the same to be more firmly supported by the railway vehicle structure.

What is claimed is:

1. A door system for a railway vehicle having a door opening and a stairwell extending downwardly from a vehicle floor level to a bottom end of said door opening, said door system comprising a sliding door displaceable between open and closed positions for selectively closing said door opening, a stairwell platform displaceable between a retracted position for clearing said stairwell and an extended position for covering said stairwell, and a threshold extending outwardly from an outer surface of said sliding door substantially at said vehicle floor level, said threshold being releasably and slidably connected to said sliding door for co-linear movement as a single unit with said sliding door between said open and closed positions when said stairwell platform is in said retracted position thereof, while remaining stationary in a functional position when said stairwell platform is in said extended position thereof for allowing high level boarding by providing a continuation of said stairwell platform.

2. A door system as defined in claim 1, wherein said threshold is disconnected from said sliding door in response to a displacement of said stairwell platform to said extended position thereof.

3. A door system as defined in claim 1, wherein said threshold is slidably connected to said sliding door, and wherein a retainer is provided for selectively keeping said threshold securely in place while said sliding door is displaced to said open position thereof.

4. A door system as defined in claim 3, wherein a latch is provided for selectively securing said threshold to said sliding door.

5. A door system as defined in claim 4, wherein said retainer is adapted to act on said latch to disconnect said threshold from said sliding door when said stairwell platform is in said extended position thereof for allowing high level boarding.

6. A door system as defined in claim 4, wherein said latch is mounted to said threshold and is normally urged to a door engaging position in which said threshold is secured to said sliding door via said latch.

7. A door system as defined in claim 6, wherein said retainer is integral to said stairwell platform and adapted, upon positioning of said stairwell platform to said extended position thereof, to disengage said latch from said sliding door in order to disconnect said threshold from said sliding door, and at the same time retain said threshold in said functional position thereof, thereby allowing said sliding door to move independently of said threshold.

8. A door system as defined in claim 7, wherein said latch is pivotally mounted to said threshold and provided with an engaging portion for engagement with a catch provided on said sliding door, said latch being normally spring biased in engagement with said catch, and wherein said retainer includes an abutment surface defined on said stairwell platform for contacting and pivoting said latch in a selected direction to displace said engaging portion of said latch out of engagement with said catch when said stairwell platform is displaced to said extended position thereof.

9. A door system for a railway vehicle having a door opening and a stairwell extending downwardly from a vehicle floor level to a bottom end of said door opening, said door system comprising a sliding door displaceable between open and closed positions for selectively closing said door opening, a stairwell platform displaceable between a retracted position for clearing said stairwell and an extended position for covering said stairwell, and a threshold extending outwardly from an outer surface of said sliding door substantially at said vehicle floor level, said threshold being adapted to jointly move as a single unit with said sliding door between said open and closed positions and to be made stationary in a functional position thereof by engagement of said threshold with a retainer upon positioning of said stairwell platform to said extended position thereof, whereby said sliding door may be displaced independently of said threshold to said open position thereof for allowing high level boarding.

10. A door system as defined in claim 9, wherein said threshold is slidably mounted on a rail secured to said sliding door.

11. A door system as defined in claim 10, wherein a latch is provided for selectively securing said threshold to said sliding door.

12. A door system as defined in claim 11, wherein said retainer is adapted to act on said latch to disconnect said threshold from said sliding door when said stairwell platform is in said extended position thereof for allowing high level boarding.

13. A door system as defined in claim 11, wherein said latch is mounted to said threshold and is normally urged to a door engaging position in which said threshold is secured to said sliding door via said latch.

14. A door system as defined in claim 13, wherein said retainer is integral to said stairwell platform and adapted, upon positioning of said stairwell platform to said extended position thereof, to disengage said latch from said sliding door in order to disconnect said threshold from said sliding door, and at the same time retain said threshold in said functional position thereof, thereby allowing said sliding door to move independently of said threshold.

15. A door system as defined in claim 14, wherein said latch is pivotally mounted to said threshold and provided with an engaging portion for engagement with a catch provided on said sliding door, said latch being normally spring biased in engagement with said catch, and wherein said retainer includes an abutment surface defined on said stairwell platform for contacting and pivoting said latch in a selected direction to displace said engaging portion of said latch out of engagement with said catch when said stairwell platform is displaced to said extended position thereof.

* * * * *